US006910623B2

(12) United States Patent
Stewart et al.

(10) Patent No.: US 6,910,623 B2
(45) Date of Patent: Jun. 28, 2005

(54) PAPERBOARD CAN WITH AN INTEGRATED LID HAVING A HINGE ON THE LID

(75) Inventors: Noel G. Stewart, Conyers, GA (US); L. David Fielder, Oxford, GA (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 69 days.

(21) Appl. No.: 09/905,639

(22) Filed: Jul. 13, 2001

(65) Prior Publication Data

US 2002/0074387 A1 Jun. 20, 2002

Related U.S. Application Data

(63) Continuation-in-part of application No. 09/527,996, filed on Mar. 17, 2000, now Pat. No. 6,390,358, which is a continuation-in-part of application No. 09/437,968, filed on Nov. 10, 1999, now Pat. No. 6,349,866.

(60) Provisional application No. 60/120,030, filed on Feb. 13, 1999.

(51) Int. Cl.[7] ..... B65D 43/16

(52) U.S. Cl. ..... 229/125.19; 229/125.17; 229/221; 229/229; 220/259.1; 220/837; 220/783

(58) Field of Search ..... 229/125.09, 125.17, 229/221, 223, 229, 259; 220/256, 254, 259, 270, 837, 783, 820

(56) References Cited

U.S. PATENT DOCUMENTS 2,399,241 A * 4/1946 Merkle ..... 229/125.09
2,493,671 A * 1/1950 Horning ..... 229/125.09 X
2,971,686 A * 2/1961 Muhlhoff ..... 229/102
3,090,542 A * 5/1963 Miller ..... 229/125.09 X
3,421,654 A * 1/1969 Hexel ..... 220/254.3
4,241,864 A * 12/1980 Kessler ..... 229/5.5
4,453,666 A * 6/1984 Gordon ..... 229/123.3
4,495,209 A * 1/1985 Whiteside ..... 229/125.13
4,819,829 A * 4/1989 Rosten et al. ..... 220/345.3
5,197,624 A * 3/1993 Dodaro ..... 220/254.3
6,355,286 B2 * 3/2002 Deering et al. ..... 229/125.06
6,395,318 B1 * 5/2002 Sumpman et al. ..... 426/115
6,471,083 B1 * 10/2002 Helms ..... 220/259.1

FOREIGN PATENT DOCUMENTS

EP 0 611 703 * 8/1994 ..... B65D/5/64

* cited by examiner

*Primary Examiner*—Tri M. Mai
(74) *Attorney, Agent, or Firm*—Armstrong Teasdale LLP

(57) ABSTRACT

A substantially paperboard container for releasably dispensing contents contained therein is convertible from a substantially sealed orientation to a substantially open, dispensing orientation and back to the substantially sealed orientation. The paperboard container comprises a tubular container member, a bottom member and a top member, with the top member being telescopically received within the container member to seal the top member to the container. The top member is pivotable about the hinge portion and is pivotable to the sealed orientation to substantially reseal the container member. The lid is fabricated in whole or in part, from plastic material.

16 Claims, 8 Drawing Sheets

700
702
704
706
707
708
710
712
714
716
718
720
722
724
726
728
730
732
734
740
742

PAPERBOARD CAN WITH AN INTEGRATED LID HAVING A HINGE ON THE LID

CROSS-REFERENCE TO RELATED APPLICATIONS

This application is a continuation-in-part of and claims the benefit of U.S. patent application Ser. No. 09/527,996, filed Mar. 17, 2000, now U.S. Pat. No. 6,390,358 which, in turn, is a continuation-in-part and claimed priority of U.S. patent application Ser. No. 09/437,968, filed Nov. 10, 1999, now U.S. Pat. No. 6,349,866 which, in turn, claimed priority of U.S. Provisional Application No. 60/120,030, filed Feb. 13, 1999.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE DISCLOSURE

1. Field of the Invention

The present invention is directed to paperboard lids for paperboard containers and, more specifically, to an integrated paperboard lid having a hinge on the lid. The present invention is also directed to lids for paperboard containers, and more specifically, to lids that are fabricated in whole or in part, from plastic material.

2. Background Art

Paper containers are often used to hold consumer items such as cereals, grains, etc. To open the container, often, the consumer simply opens the entire top of the container. This allows access to the inner liner that holds the products. This arrangement is typical of boxes of breakfast cereal. Other boxes include a perforated portion on the side of the box, near the top, or on the top of the box, near the side. The perforated portion, when separated from the box, creates an openable flap that allows access to the interior of the box. This type of construction, which is often found on boxes of grain, soap and other products, does not allow for effective closing of the box.

It is therefore an object of the present invention to provide a container that is convertible from a substantially sealed orientation to a substantially open, dispensing orientation and back to the substantially sealed orientation.

It is also an object of the present invention to provide a container that is capable of remaining in a substantially open, dispensing orientation without obstructing the dispensing of contents contained therein.

It is a further object of the present invention to provide a container that is capable of reclosing from a substantially open orientation to a substantially sealed orientation without the loss of contents contained therein.

It would also be desirable to provide a lid for a paperboard can that is fabricated in whole or in part from plastic material.

It would be further desirable to provide a whole or partially plastic lid that is configured to have a stay-open feature.

These and other objects of the present invention will become apparent in light of the present specification, claims and drawings.

SUMMARY OF THE INVENTION

The present invention is directed to a paperboard container for releasably dispensing contents contained therein.

The container is convertible from a substantially sealed orientation to a substantially open, dispensing orientation and back to the substantially sealed orientation.

The paperboard container comprises a tubular body having an upper edge defining an upper opening. A lid includes a substantially planar lid panel member having a peripheral edge region, the lid panel member being operably configured to extend across at least a portion of the upper opening.

The lid further includes a surrounding band, operably affixed to the lid panel member along the peripheral edge region thereof. At least portions of the surrounding band are affixed to the tubular body along at least a portion of the upper edge thereof. The lid further has a fixed back portion, a hinge portion, and a movable front portion, pivotable between a closed position and an open position. The paperboard container further includes a container bottom opposite said lid.

The paperboard container further comprises, in a preferred embodiment of the invention, a membrane extending across the upper opening of the tubular body portion, under the lid panel, and substantially independent of the lid portion. The membrane may be positioned on the top edge of the upper opening of the tubular body portion. Alternatively, the membrane may be inserted into and affixed to inside surfaces of the upper opening of the tubular body portion.

The hinge portion may further comprise at least one locking tab operably extending from the hinge portion, when the movable front portion of the lid is in the open position, for frictionally engaging the membrane, to maintain the movable front portion of the lid in the open position.

The lid panel may be plug-shaped, so as to extend into the upper opening of the tubular body portion, when the movable front portion of the lid is in its closed position.

The movable front portion of the lid may include at least one tooth for engaging the container member upper edge when the top member is in its sealed orientation. The hinge portion may include at least two tabs extending rearwardly toward the rear portion, the at least two hinges being sized to engage the membrane when the movable front portion of the lid is in its open orientation and to hold the front portion in the open orientation.

The bottom preferably comprises a bottom panel inserted into and adhered to inside surfaces of a bottom end region of the tubular body portion.

In a preferred embodiment of the invention, the lid is formed by insertion of the lid panel into the band, the lid panel having a width and length greater than the width and length of the band, causing peripheral edges of the lid panel to become upturned and positioned against inside surfaces of the band, and the upturned peripheral edges of the lid panel are adhered to the inside surfaces of the band.

A topmost edge region of the band may be curled inward. Alternatively, a topmost edge region of the band is left in a straight vertical orientation. In a still further alternative embodiment, a topmost edge region of the band is curled outward.

According to one alternative embodiment of the invention, the upper edge of the tubular body is curled inward. Alternatively, the upper edge of the tubular body may be left in a straight vertical orientation. In a still further alternative embodiment, the upper edge of the tubular body is curled outward.

In an alternative embodiment of the invention, the lid is fabricated at least in part from plastic. Specifically, the invention comprises a container for releasably dispensing contents contained therein, the container being convertible from a substantially sealed orientation to a substantially open, dispensing orientation and back to the substantially sealed orientation.

The container comprises a paperboard tubular body having an upper edge defining an upper opening and a lid, including a substantially planar lid panel member having a peripheral edge region. The lid panel member is operably configured to extend across at least a portion of the upper opening.

The lid further includes a band operably connected to the lid panel member along the peripheral edge region thereof. The band extends generally at right angles to the lid panel. At least portions of the band are juxtaposed and affixed to the tubular body along at least a portion of the tubular body proximate the upper edge thereof. The lid has a fixed back portion for maintenance in a position juxtaposing the band to the interior of the tubular body at its upper edge, a hinge portion, and a movable front portion, pivotable at the hinge portion, between a closed position adjacent the edge , and an open position enabling access to an interior region of the tubular body. A container bottom is disposed opposite the lid.

The lid is preferably fabricated from at least one of the following materials: polystyrene, polypropylene, LDPE, HDPE or other polymers.

The lid preferably may further comprise means for enabling the lid to be fixedly yet releasably positioned in a stable, open, raised position, subsequent to opening of the container and pivoting of the movable front portion of the lid up to a predetermined position.

The means for enabling releasable, fixed positioning of the lid in a stable, open, raised position, subsequent to opening of the container and pivoting the movable front portion of the lid up to a predetermined position, may, in turn, comprise at least one retaining ridge, operably emanating inwardly from an inside surface of the band, disposed within the fixed back portion of the lid; and an outwardly extending lip portion, operably disposed on the movable portion of the lid at least adjacent the retaining ridge, and configured to interferingly engage with the at least one retaining ridge, when the movable portion of the lid is raised to an open position, to enable the at least one retaining ridge to hold the movable portion of the lid in a stable, releasable, raised position.

The container may further comprise a membrane extending across the upper opening of the tubular body portion, under the lid panel, and substantially independent of the lid portion. The membrane may be positioned on the top edge of the upper opening of the tubular body portion, below the lid.

The membrane may be inserted into and affixed to the inside surfaces of the upper opening of the tubular body portion.

In a preferred embodiment of the invention, the lid panel is plug-shaped, so as to extend into the upper opening of the tubular body portion, when the movable front portion of the lid is in its closed position.

The bottom preferably comprises a bottom panel inserted into and adhered to inside surfaces of a bottom end region of the tubular body portion.

The lid is preferably monolithically formed from a single piece of plastic material, or injected into a mold.

The container may further comprise a gripping tab emanating from a portion of the surrounding band adjacent the movable front portion, operably configured for the facilitated manual opening of the lid.

The lid may further include a lip emanating outwardly from an upper edge region of the band, around the substantial entire circumference of the band. The lip may rest on the upper edge of the tubular body of the container upon insertion of the lid into the tubular body, to assist in maintaining the lid in a secured position inside the tubular body.

The band of the lid may include a beveled portion to facilitate insertion of the lid into the tubular body of the container.

In an alternative embodiment of the invention, the lid comprises a discrete lid panel and a discrete surrounding band, affixed to the discrete lid panel.

In an alternative embodiment of the invention, the means for enabling the lid to be positioned in a stable, open, raised position, subsequent to opening of the container and pivoting the movable front portion of the lid up to a predetermined position, may, in turn, comprise a retaining block, operably formed on an emanating upwardly from an upper surface of one of the front and rear portions of the lid; and means for receiving and frictionally gripping the retaining block, operably disposed on one of the rear and front portions of the lid, upon pivoting of the movable front portion toward the fixed back portion.

The container may further include at least one reinforcing rib on the lid, extending from an inside surface of the band, inwardly and downwardly to an upper surface of the lid panel, for providing structural reinforcement of the band.

The container may further include at least one circumferentially extending ridge, emanating from an outside surface of the band, for providing frictional engagement between the band and the inside surface of the upper end of the tubular body, upon insertion of the lid into the tubular body.

DETAILED DESCRIPTION OF THE DRAWINGS

Figure 1:
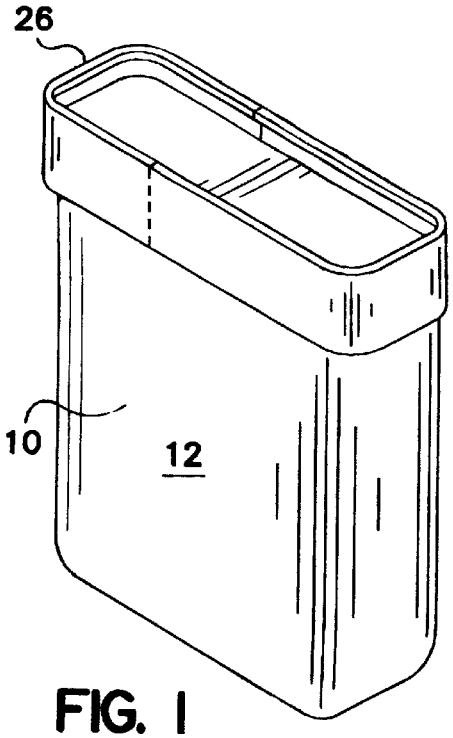
FIG. 1 is a perspective view of the paper can apparatus of the present invention.

While this invention is susceptible of embodiment in many different forms, there are shown in the drawings and will be described in detail herein, several specific embodiments with the understanding that the present invention is to be considered as an exemplification of the principles of the invention and is not intended to limit the invention to the embodiments illustrated.

Figure 2:
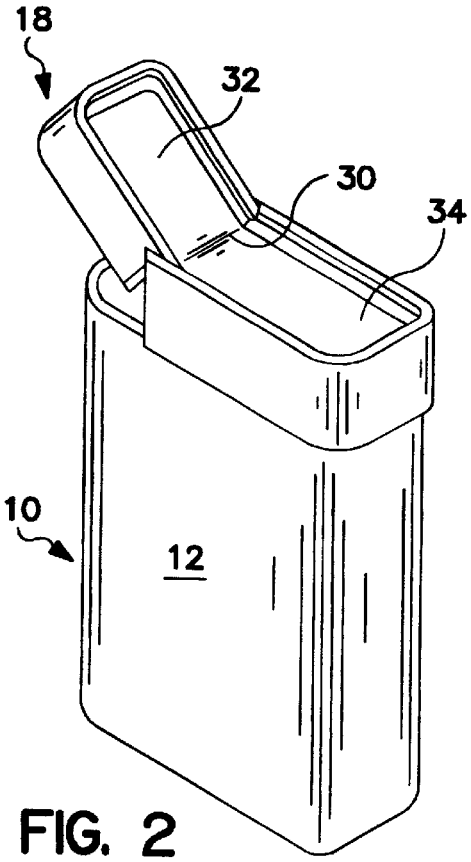
FIG. 2 is a perspective view of the paper can of FIG. 1, showing the flip open top in an opened position.
Figure 3:
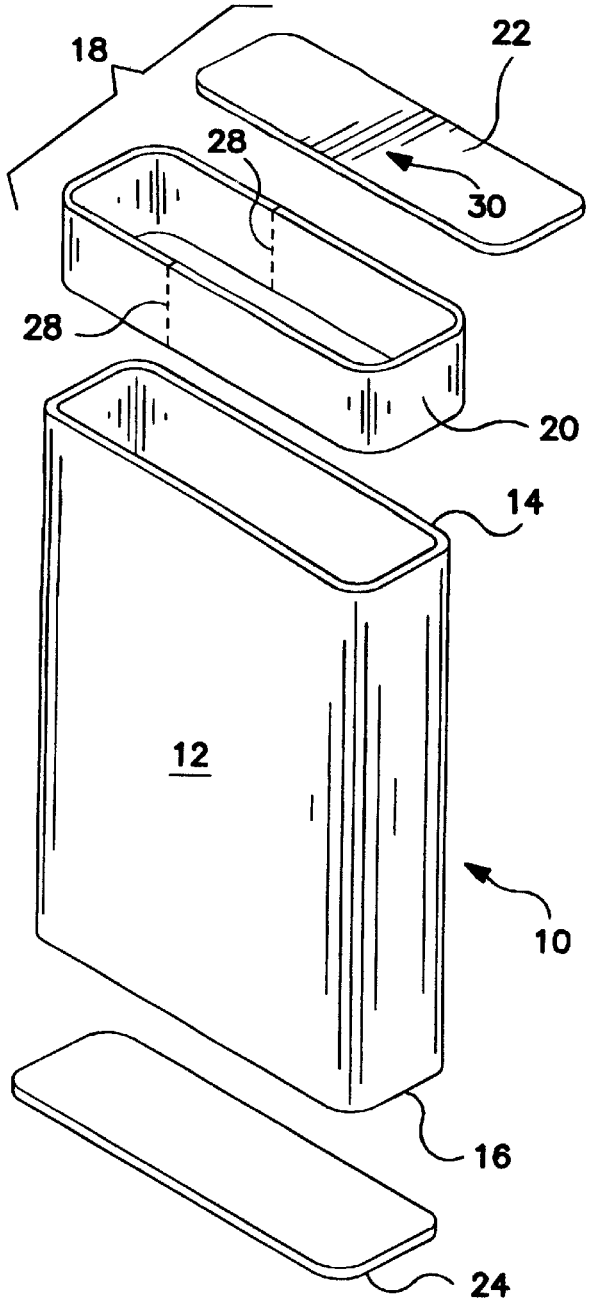
FIG. 3 is a perspective exploded view of the paper can of FIGS. 1–3, of the present invention.

One embodiment of a paperboard container 10 of the present invention is shown generally in FIGS. 1–3. The container 10 includes a main body or tube portion 12 having a top edge 14 and a bottom edge 16. The body 12 has side walls defining a chamber that is opened at its top and bottom. The body 12 shown in the drawings is generally quadrilateral in plan view. However, the body could be circular, triangular, or any other desired shape. Two piece lid 18 is formed from an encircling band 20 and a lid panel 22. Container 10 also includes bottom panel 24.

The top edge 26 of lid 18 may be straight or curled, as desired for a particular application. Band 20 preferably has two vertical lines of perforations or deep score lines 28. Lid panel 22 may be provided with a transverse score 30, that may serve as a fold line, for facilitating opening of the flip top portion 32 of the lid 18. Band 20 may be formed as a strip of material that has been formed into a tube, and then cut into short sections, into each of which a corresponding lid panel 22 may be inserted and affixed.

Once the completed lid 18 has been fabricated, it may be placed onto and affixed to the top edge 14 of body 12. Typically, lid 18 will have length and width dimensions that are greater than the top edge 14 of body 12. Accordingly, band 20 will circumferentially surround the top of body 12.

A portion of the inner surface of band 20 will be provided with an adhesive material, or a heat-or sonically activatable layer (for example a lamination of sonically weldable material), to affix lid 18 in place.

Preferably, the portion 34 of lid 18 that remains fixed to body 12 will be provided with a substantial amount of adhesive, or sonically or heat-activatable material, on the inner surface of its portion of band 20. However, the flip top portion 32 preferably will have only a few spots of adhesive or heat or sonically activatable material. This is so that upon application of a moderate amount of upward pulling, the weak bonds between the band portion of flip top 32, can be broken, band 20 can be severed along score/perforation lines 28, and flip top portion 32 pivoted about score 30 upward and away from top edge 14 of body 12.

As previously mentioned, according to a preferred embodiment of the invention, the lid may be completely formed, prior to affixation to the top of body 12. For example, band 20 may be wrapped around lid panel 22 prior to affixation of lid 18 to body 12. Alternatively, band 20 may be affixed to body 12, prior to insertion of lid panel 22. In either embodiment, placement of the lid panel 22 into band 20 may be accomplished by any suitable manner, such as the technique illustrated in Christensson, U.S. Pat. No. 4,599,123. In such a technique, either or both of the bottom surface of the lid panel 22, or the inside surface of the band 20, would be covered in a sonically weldable material. The presence of such a material may be provided by laminating a layer of sonically weldable material to a base layer of, for example, sufficiently heavy cardboard material. The outer surface of the base layer may further have an additional lamination layer that is covered in printing, graphics, etc.

To position the lid panel, the band is surrounded by a clamping structure that may incorporate an ultrasonic horn structure. Above the band, a female die member is provided with an aperture that is of the desired dimensions. A laminated lid panel member is placed above the die, and a male forming member pushes the lid panel member through the female die member and into the band. Edge regions of the lid panel member (see FIG. 6) will be turned upward and into contact with portions of the inside surface of the band. The male forming member may include expandable structures or other structures that will enhance the contact between the upwardly turned portions of the lid panel and the adjacent portions of the band. The ultrasonic horn will be activated, and a localized weld will be formed.

Alternatively, a heat activatable layer may be employed, and heating of the layer may be accomplished by generally heating the clamping structures used to position the lid panel in the band.

After the lid panel has been welded to the band, the top edge(s) of the band and/or the upwardly turned portion of the lid panel may be curled inward, if desired, using known techniques for inwardly turning the edges of tubular bodies. The curled inward portion of the band may or may not be curled so much as to actually cover the upturned peripheral edges of the lid panel. In the figures, the curled inward portion does not cover the upturned peripheral edges of the lid panel. Alternatively, the top edge region of the band may be left in a straight vertical orientation. Similarly, the top edge region of the tubular body portion may be left in a straight vertical orientation, as illustrated, or curled inwardly or outwardly, if desired.

Depending upon the shape of the male forming member, and the size of the unformed lid panel, the lid panel may be formed with a deep profile, to form a plug structure that fits snugly into the inside of the top of body 12, so that top edge 14 of body 12 actually wedges between the plug structure and band 20. In this manner, a form of seal can be created, to help maintain freshness of perishable contents of the container. A second cooperating male die member may also be used to mate with the first male die member, to facilitate creation of the plug configuration.

After the lid has been attached to the container, the container is inverted, and the product to be packaged is poured or otherwise placed in the container, through the open bottom of the tubular body portion. A bottom panel 24 is then inserted and affixed to the bottom end of the tubular body portion, using any desired conventional technique. For example, the bottom panel may be laminated, with an inner surface layer of a heat or sonically activatable material, or glueable. Upon insertion of the bottom panel, using a male forming member, and holding the bottom of the container with a surrounding die, that is heated or includes an ultrasonic horn, the peripheral edges of the bottom panel may be adhered to inside surfaces of the bottom end region of the tubular body member.

In the embodiment of FIGS. 1–3, each of the tubular body 12, lid panel 22 and band 20 may be fabricated from one or more layers of paperboard material, such as cardboard, paperboard, corrugated or flexible films, though other materials may be employed, as desired or dictated by the requirements of any particular application. The material may be laminated with one or more layers (inside or outside) of a moisture resistant material, to resist intrusion of moisture into the interior of container 10 and to aid in sealing.

As an alternative to sizing and placing the lid on the tubular body portion in such a way that the band surrounds and is in contact with the outside of the top of the tubular body portion, the lid may be configured so that the band lies to the inside of the tubular body portion wall. While this may require some accommodation at the flip top portion, such as by beveling a portion of the band to clear the top edge of the body, such modifications may readily be accomplished by one of ordinary skill in the art, having the present disclosure before them.

The paper cans of the present invention may include an inner sealing membrane that may be provided in order to further preserve freshness of perishable or semi-perishable contents, until purchase by a consumer. Such interior membranes may also serve as further evidence of tampering, if broken or otherwise disturbed.

Figure 4:
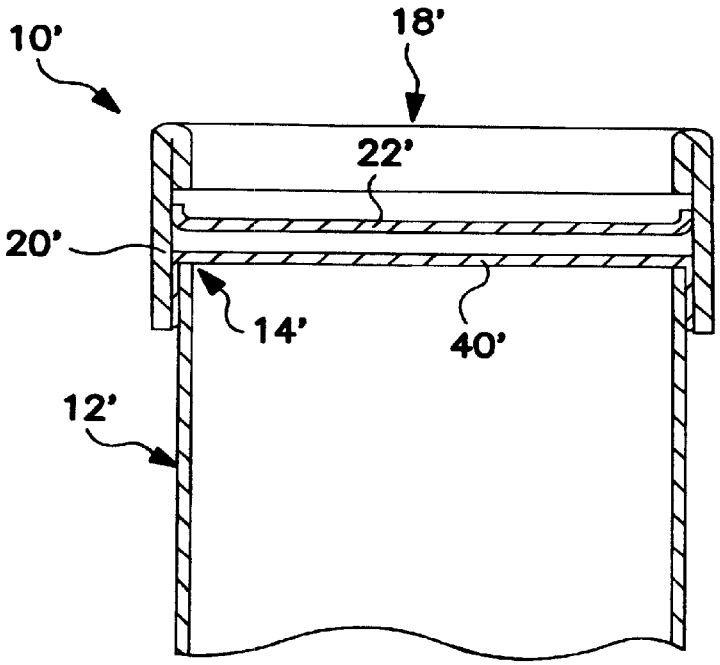
FIG. 4 is an end elevation, in section, of the paper can of FIGS. 1–3, showing a sealing membrane in place between the lid and the tubular body, according to one embodiment of the invention.
Figure 5:
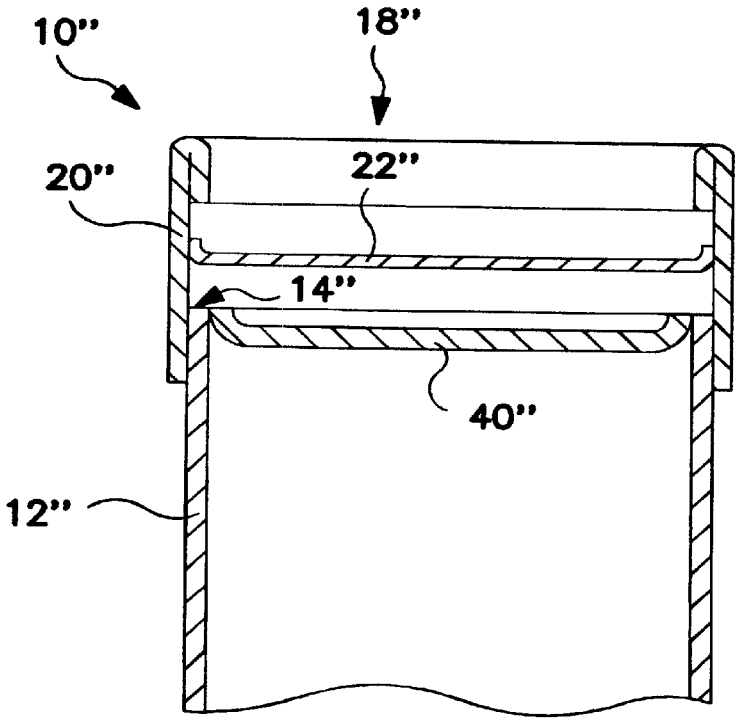
FIG. 5 is an end elevation, in section, of the paper can of FIGS. 1–3, showing a membrane positioned within the top opening of the tubular body, according to another embodiment of the invention.

FIGS. 4 and 5 illustrate two embodiments of the paper can of the present invention, incorporating interior membranes.

In FIG. 4, container 10' has tubular body 12', and lid 18', formed from band 20' and lid panel 22'. Membrane 40' is interposed between lid 18' and the top edge 14' of tubular body 12'. Preferably, membrane 40' is fabricated from any suitable paper or plastic material, and covers the entire top opening of tubular body 12'. In addition, preferably membrane 40' is substantially thinner than the material of tubular body 12' or lid 18'. Membrane 40' may be held in place by a bead of adhesive material (not shown) or may itself be fabricated from a heat or sonically activatable material, to adhere to top edge 14' and the adjacent outside surface of tubular body 12', if desired. Alternatively, membrane 40' may be precisely cut, so that it does not extend significantly down the outside surfaces of tubular body 12'. The placement of membrane 40' onto tubular body 12' may be accomplished according to any one of several known techniques. Accordingly, a detailed discussion of the methods and/or apparatus used is not believed necessary for a complete understanding of this aspect of the container.

After placement of membrane 40' on tubular body 12', lid 18' may then be applied to or affixed to tubular body 12', in either of the ways previously discussed, with respect to the container embodiment of FIGS. 1–3.

In the alternative embodiment of FIG. 5, membrane 40" is inserted into the top opening of tubular body 12" and is affixed around its edges to the inside surface of tubular body 12". Membrane 40" may be inserted into tubular body 12" and held in place by a circumferentially placed bead of adhesive (not shown). Alternatively, membrane 40" (or at least one layer thereof) may be fabricated from a heat or sonically activatable material, so that upon insertion of membrane 40", using a male forming member (not shown), the activatable layer may be activated by a collar surrounding tubular body 12" (not shown) that incorporates a heating element or an ultrasonic horn. Such schemes are known in the art, through examples such as the previously mentioned Christensson '123 patent.

In either of the embodiments of FIG. 4 or 5, the membranes 40', 40" may be provided with perforations, pull tabs, scores, or other features (not shown, but known in the art of sealing membranes) for facilitating breaching or removal of at least a portion of the membrane 40' or 40", to permit access to the contents of the container 10', 10".

Figure 6:
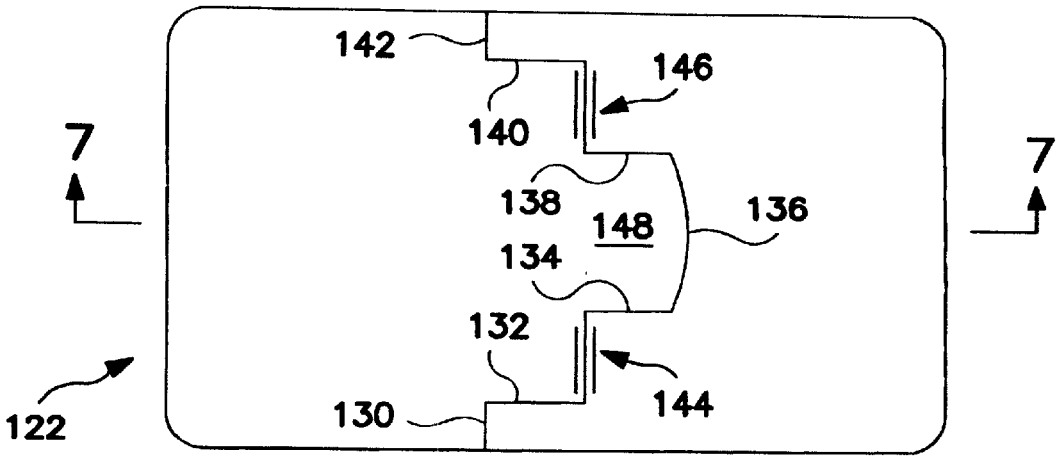
FIG. 6 is a plan view of an alternative lid panel, according to an alternative embodiment of the invention that provides for a "stay-open" feature.
Figure 7:
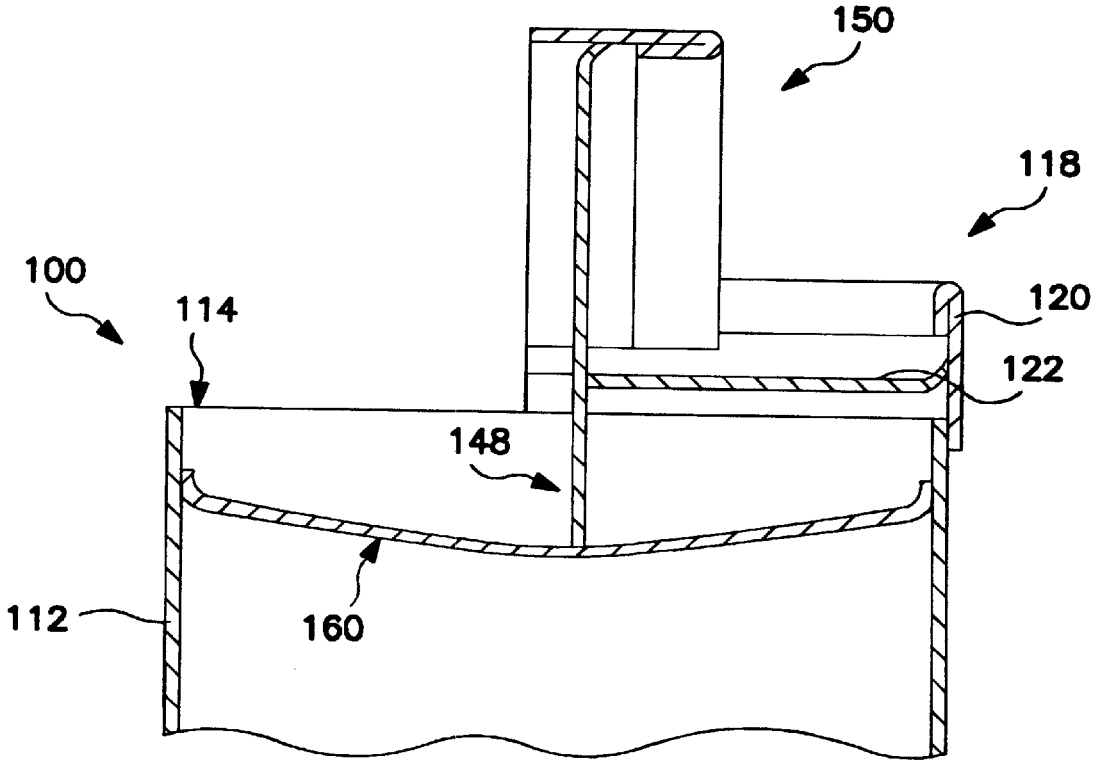
FIG. 7 is a side elevation, in section, of an alternative paper can container, incorporating the lid panel of FIG. 6.
Figure 8:
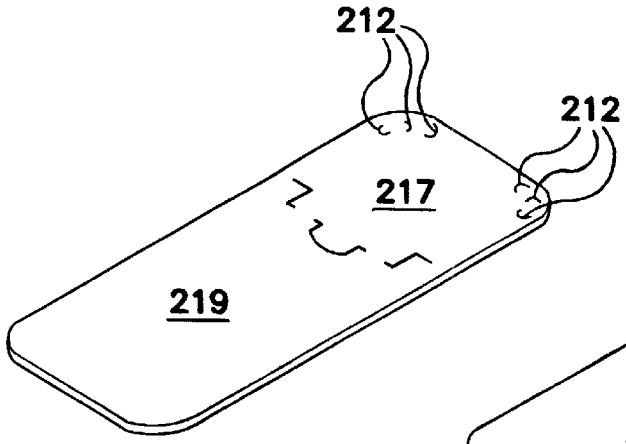
FIG. 8 is a perspective view of an alternative lid panel.
Figure 10:
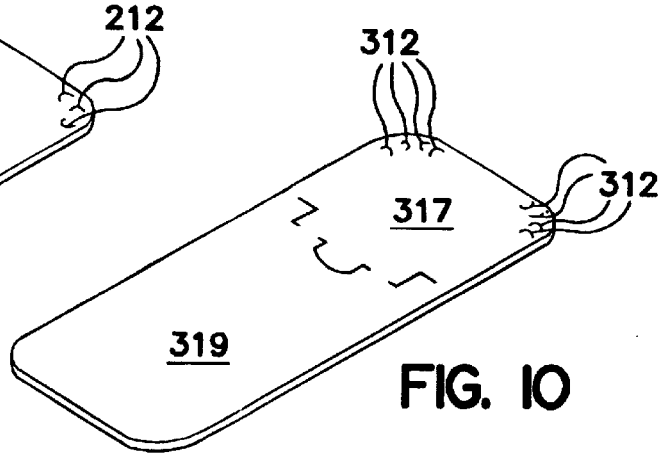
FIG. 10 is a perspective view of an alternative lid panel.
Figure 9:
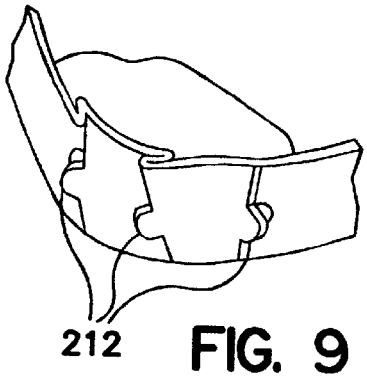
FIG. 9 is a perspective view of the alternative lid panel of FIG. 8, showing how the lid panel can be configured to provide enhanced friction, relative to the tubular body portion.
Figure 11:
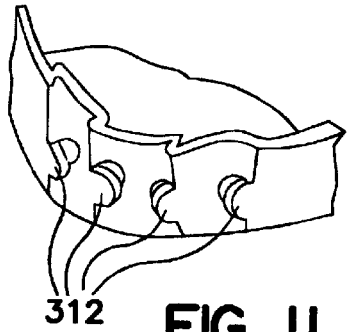
FIG. 11 is a perspective view of the alternative lid panel of FIG. 10, showing how the lid panel can be configured to provide enhanced friction, relative to the tubular body portion.

FIG. 6 is a top plan view of an alternative lid panel 122, for use in an alternative embodiment paper can 100, shown in FIG. 7. Lid panel 122 includes a series of cuts 130, 132, 134, 136, 138, 140 and 142, and two fold lines 144, 146. When lid panel 122 is placed into a container, having a configuration like the embodiment of FIG. 5, for example, the resulting container is that shown in FIG. 7. Container 100 includes tubular body 112, having top edge 114. Lid 118 includes band 120 and lid panel 122. When the flip top portion 150 is pivoted upward, it pivots around fold lines 144, 146. Cuts 134, 136 and 138 form a tab 148 that, upon pivoting of flip top portion 150, presses down into membrane 160. The resulting tension creates friction that tends to hold flip top portion 150 in the position indicated in FIG. 7.

Other embodiments of the invention are shown in FIGS. 8–11. These embodiments illustrate lid panels that would be used, in which the lid panel is drawn deeply enough, and positioned relative to the surrounding band, and the top edge of the tubular body portion, that the lid panel acts as a "plug" to engage the inside surface of the top of the tubular body portion. The container (not shown) associated with the lid panel 219 and 319 of FIGS. 8 and 10, may otherwise be of the configuration shown in FIGS. 6 and 7, but with the plug-like feature previously mentioned. Lid panels 219 and 319 are similar to lid panel 122. The difference lies in the peripheral edges of lid front portions 217 and 317. Lid front portions 217 and 317 include equidistantly spaced teeth 212 and 312 (FIGS. 9 and 11) on their peripheral edges. Engagement of teeth 212 and 312 with the tubular body portion (not shown) creates a further frictional engagement between the lid and the inside surface of the top edge region of the tubular body portion that will help maintain the pivoting portions of the lid panels 219, 319 in their respective closed positions.

Figure 12:
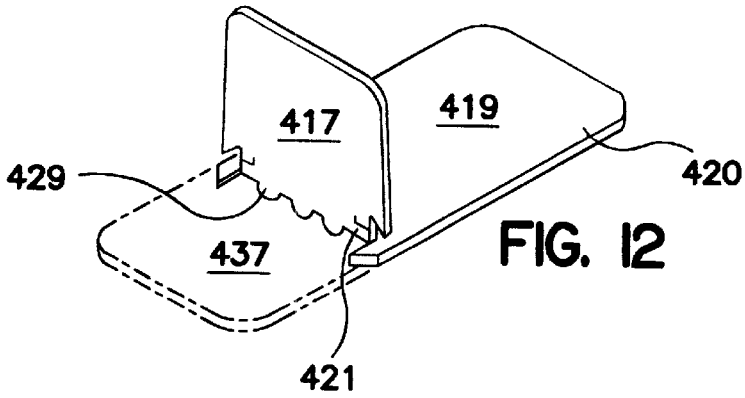
FIG. 12 is a perspective view of another alternative lid panel, according to another alternative embodiment of the invention.

Still another alternative embodiment for the lid panel is shown in FIG. 12. The container (not shown) associated with FIG. 12 may have substantially the same construction as the container 100 of FIG. 7. It varies in the construction of lid panel 419. Fold line 421 separates the lid panel front portion 417 from the lid panel rear portion 420. Fold line 421 includes three spaced tabs or détentes 429, that may be equally or unequally spaced. The tab 429 is formed to extend toward the lid panel rear portion 320. To form each of tabs 429, a partial cut, in a semi-circular shape, is formed on the bottom side of lid panel 419. The engagement of tabs 429 with the membrane (not shown) creates a further frictional engagement between the lid and the membrane that will help maintain the flip top portion of the lid in its opened position.

In alternative embodiments of the foregoing constructions, all or part of the various lid structures shown in FIGS. 1–12 may be fabricated from plastic materials, with the remaining body structure still being fabricated from paperboard.

Figure 13:
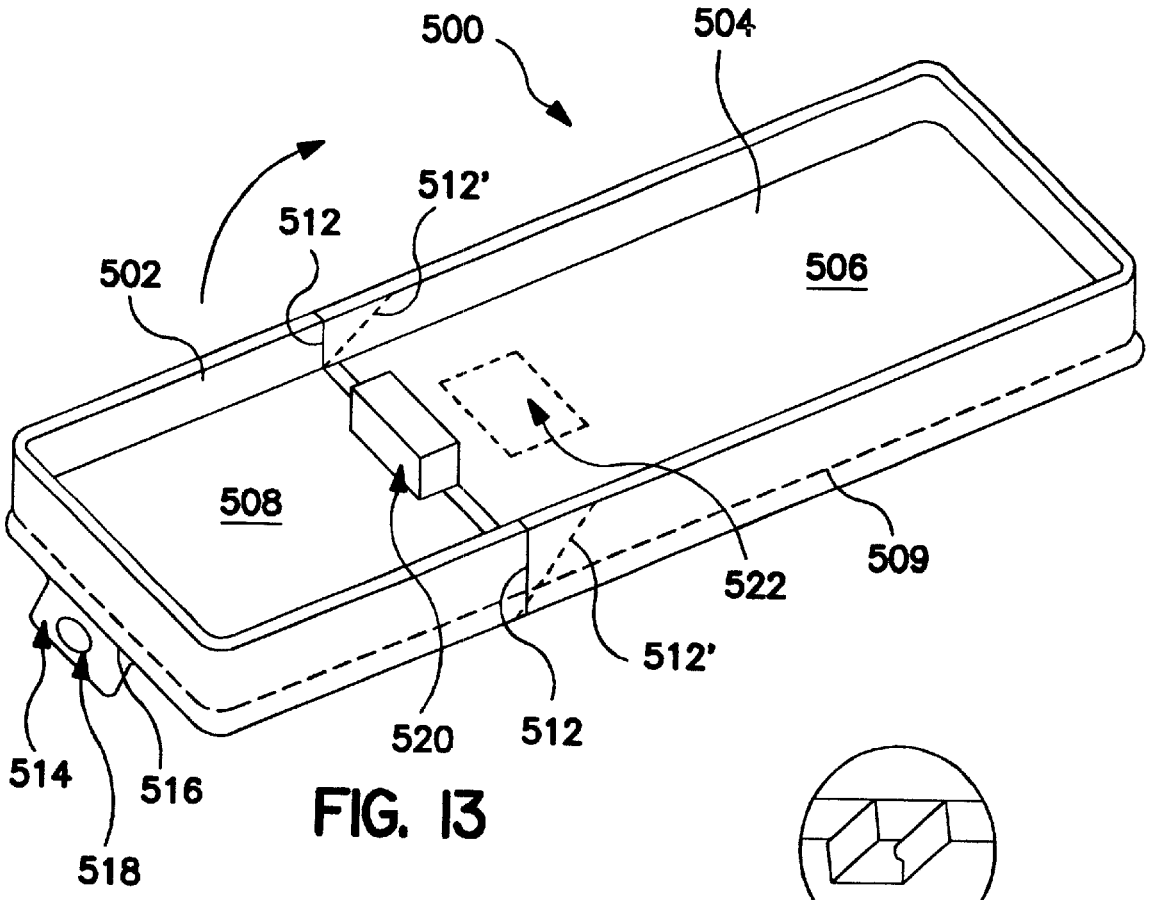
FIG. 13 is a perspective view of another alternative lid panel, according to another alternative embodiment of the invention.
Figure 14:
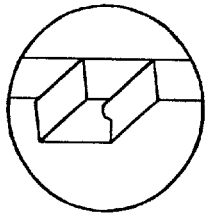
FIG. 14 is a fragmentary perspective view of a detail of an alternative construction to the embodiment of FIG. 13.
Figure 15:
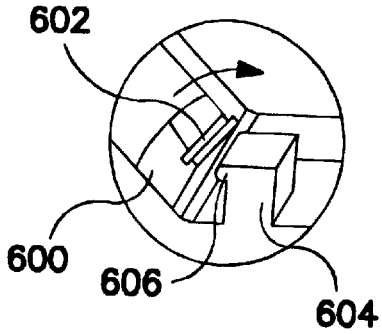
FIG. 15 is a fragmentary perspective view of a detail of an alternative construction to the embodiment of FIG. 13.

FIGS. 13–15 illustrate further alternative embodiments of the invention.

FIG. 13 is a perspective view of an alternative lid construction. Lid 500 is preferably fabricated from a plastic material, such as polystyrene or polypropylene. Lid 500 may be monolithically formed, by stamping or molding. Alternatively, lid 500 may be formed from initially separate components that are joined, e.g., by sonic or heat welding or adhesive joining.

Lid 500 includes vertical band 502, and lid panel 504. Lid panel 504, in turn, includes generally fixed portion 506, and movable portion 508. Fixed portion 506 is separated from movable portion 508 by hinge area 510, that may be formed by two parallel creases or lines of weakening (as shown) or by a single line of weakness (not shown). Lid panel 504 is joined to or formed to band 502, preferably at a level 509 between the top and bottom edges of band 502. This will leave a portion of the inside surface of band 502, below lid panel 504 available to be adhesively affixed (or sonically or heat sealed) to an upper outer surface of the top edge of a tubular container body, as in the embodiment shown in FIGS. 1–3.

Band 502 is additionally provided with a pair of opposed vertical cuts, lines of perforation, or other lines of weakness 512. When the movable portion 508 of the lid is raised, the edges of the band along line 512 provide a frictional interference with the edges of band 512 of the non-movable portion, in a manner substantially the same as in the previously described embodiments. In an alternative embodiment, line of weakness 512' is at an angle to level 509, e.g., 45°. Line 512' and level 509 will intersect at approximately the hinge area 510.

In order to facilitate opening of lid 500, tab 514 is provided, emanating from a lower edge region of band 502, adjacent moveable portion 508. Score 516 separates tab 514 from band 502. Tab 514 is held against the side of the body of the container (not shown) by a dot of adhesive 518. Opening of the container is achieved by lifting up tab 514 and pulling up and back toward fixed portion 506.

In addition to or as an alternative to the frictional engagement of the free edges of the band adjacent line 512/512', a stay-open feature is provided. For example, male locking block 520 may be provided, emanating upwardly from movable portion 508 of lid panel 504. A female locking receiver region 522 is provided in fixed portion 506, in the form of a region of perforations or other line of weakness, having a peripheral shape, preferably the same or slightly smaller in dimension than the peripheral shape of male locking block 520. As the movable portion is pivoted back, in the direction of the curved arrow, block 520 pushes against region 522, pushing out the area surrounded by the line of weakness, until a top portion of block 520 is insertably received into the opening thus created. If the fit is close enough, the periphery of the hole created "grabs" block 520 and serves to hold the movable portion of the lid open.

FIG. 14 illustrates two alternative embodiments of the invention. Where mere friction might be deemed insufficient, a notched structure may be provided. For example, the region shown in FIG. 14 may be a depression formed (e.g., by molding) in the movable portion of the lid, with a transverse ridge formed along one top edge of the depression. A raised block (not shown) having a corresponding transverse notch may be formed in the non-movable portion of the lid, so that upon opening of the container and pivoting back of the movable portion, the ridge in the depression engages and latches, preferably with a snap fit, into the corresponding notch, to hold up the movable portion of the lid. Conversely, the region of FIG. 14 may be a depression formed in the non-movable portion of the lid, with the corresponding raised block with transverse notch being formed on the movable portion of the lid.

FIG. 15 shows a still further alternative embodiment of the invention, in which raised blocks are formed on both the movable and non-movable portions of the lid. The block 600 on the movable portion of the lid has a transverse notch 602. The block 604 on the non-movable portion of the lid has a transverse ridge 606. The blocks 600 and 604 are positioned so that upon raising of the movable portion of the lid, notch 602 receives, with a snap fit, ridge 606. In an alternative to FIG. 15, the notch may be formed on block 604, and the ridge formed on block 600.

Figures 16, 17, 18:
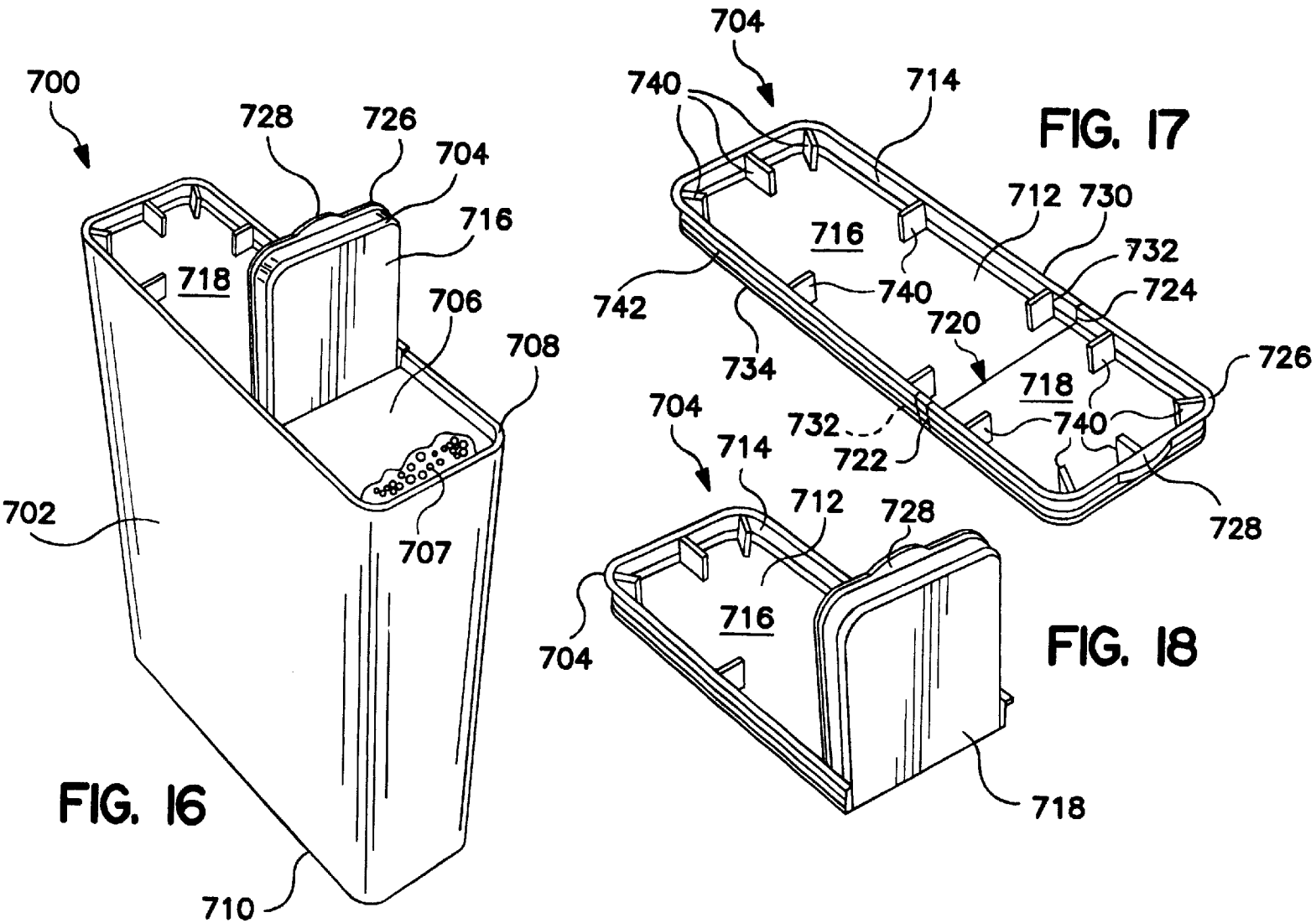
FIG. 16 is a perspective view of another alternative lid panel as attached to a paper can apparatus, according to another embodiment of the invention, with the flip-open top portion of the lid in an open position.
FIG. 17 is a perspective view of the lid panel of FIG. 16.
FIG. 18 is a perspective view of the lid panel of FIG. 16 shown with the flip-top portion of the lid secured in an open position.

In another embodiment, shown in FIGS. 16–18, container 700 includes tube portion 702, another alternative lid construction 704 and membrane 706. Tube portion 702, as has been described above, is preferably constructed from paper or paperboard material, and includes top edge 708 and bottom edge 710.

Lid 704 is shown in FIGS. 16–18 as preferably fabricated from a plastic material, such as polystyrene, polypropylene, LDPE, HDPE or other polymers. Lid 704 is preferably a single piece, preferably monolithically formed by molding. Alternatively, lid 704 may also be formed from independent components which are joined or formed together, such as by sonic or heat welding or adhesive joining.

Lid 704 includes lid panel 712 and vertical band 714. Lid panel 712 is the substantially horizontal component of lid 704, and further includes fixed portion 716, moveable portion 718 and hinge portion 720. Lid 704 is intended to be inserted, plug-like, into the open top end of tube portion 702. As can be seen from FIG. 17, fixed portion 716 is joined to moveable portion 718 by hinge portion 720, which allows moveable portion 718 to hingedly pivot relative to fixed portion 716. Further, while hinge portion 720 is shown as a general line of weakness, including several parallel creases, hinge portion may be formed by score lines, or any other line which facilitates hinged movement of the moveable portion of the lid relative to the fixed portion of the lid.

Vertical band 714 extends upwardly from lid panel 712, and includes cut lines 722 and 724, lip 726, tab 728 and stay-open feature 730. As can be seen from FIG. 17, cut lines 722 and 724 extend through both the vertical portion of vertical band 714, as well as through the more horizontal lip portion 726 of vertical band 714, to facilitate manipulation of moveable portion 718 relative to fixed portion 716. Cut lines 722 and 724 may include a complete severing of the adjacent moveable and fixed portions of vertical band 714, or may be initially, temporarily connected. For instance, connection between a portion of the moveable and fixed portions of the lid may be maintained during the formation process. Alternatively, such a temporary connection may be achieved through score lines, or through an alternative connector independent of the lid, such as adhesive, tape strips, etc. This initial, temporary connection may help prevent the moveable portion of lid 704 from being inadvertently opened during formation of the container, or during storage, shipping or retail shelving of the container.

Lip 726 is shown as substantially horizontal in orientation, extending outward from the vertical portion of vertical band 714. Lip 726 is preferably of a dimension, which substantially matches the thickness of tube portion 702, such that lid 704 sits directly and flush on top edge 708 of tube portion 702. This construction eliminates the need to manipulate the top edge 708 of the tube portion 702, either prior to or during insertion of lid 704 into tube portion 702 to form the container 700. Thus, top edge 708 need not be curled outwardly, curled inwardly or altered in any other manner.

Tab 728 is shown in FIGS. 16–18 as extending from vertical band 714 of lid 704. Tab 728 extends beyond top edge 708 of tube portion 702 when lid 704 is positioned inside tube portion 702. Accordingly, tab 728 hangs over the edge of the container to allow a user to lift up moveable portion 718 of lid 704. It is likewise contemplated that the tab may take other configurations, as well as other positions on the moveable portion of the lid.

Stay-open feature 730 is shown in FIG. 17 as comprising ridges 732. While the vertical band of movable portion 718 frictionally engages the vertical band of fixed portion 716 to both resist opening of the lid and to help maintain the movable portion of the lid in an open position for dispensing of the contents of container 700, stay-open feature 730 preferably includes ridges 732 which help maintain fixed portion 716 in an upright, open and dispensing orientation such as that shown in FIGS. 16 and 18. Specifically, portions of lip 726 snap behind ridges 732, when the lid is raised, to create an interference engagement, holding movable portion 718 up in an upright, dispensing orientation. Of course, it is likewise contemplated that numerous other stay-open mechanisms may be used in conjunction with the present lid, such as depression-detent, ridge-groove or other mating combinations on the respective fixed 716 and moveable 718 portions of lid 704.

Vertical band 714 may further include a beveled portion 734 positioned between lid panel 712 and the substantially vertical portion of vertical band 714. Beveled portion 734 facilitates insertion of lid 704 into tubular body 702. One or more circumferentially extending ribs 742 (shown in FIG. 17 only) may also be provided, emanating from the outside surface of band 714, for providing frictional engagement between the band and the inside surface of the upper end of the tubular body, to provide at least temporary retention of the lid (e.g., to prevent it from being popped off by the squeezing force of the tube), prior to setting of whatever adhesive or other material may be employed to permanently affix the lid to the body. In addition, the rib(s) 742 on the movable portion of the lid may provide additional frictional assistance in holding the movable portion down in the closed position, between openings.

Membrane 706 is shown in FIG. 16 as attached to the inside walls of tube portion 702, below lid 704. Membrane 706 may be attached to tube portion 702 independent from lid 704, such as by sonic or heat welding, gluing or adhesive. Membrane 706 is shown in FIG. 16 partially removed to reveal the contents 707, such as dry cereal, for example. In another alternative embodiment, the membrane may also be attached to the lid in only selected areas to trigger breaking of the membrane seal upon opening of the lid. Of course, those of ordinary skill in the art will appreciate the various ways that the membrane may be inserted into the container, independent of or in combination with the lid.

In addition, the embodiment of FIGS. 16–19 may be provided with a series of vertically-oriented, inwardly-projecting ribs 740. These ribs 740 may provide strength and reinforcement to vertical band 714. This may help prevent inward crushing or curling of the top edge of the container. The number, placement and dimensions of ribs 740 may be varied as desired and appropriate for any given application. However, in a preferred embodiment of the invention, for a lid having a length of about 21 cm, a width of about 7 cm and a depth of about 1 cm, ribs 740 may have a width (distance they project from the inside surface of vertical band 714) of about 0.5 cm. In addition, ridges 732 may have a width of about 1.5–2 mm. Such dimensions may facilitate the "grabbing" of ridges 732 by lip 726, as occurs, when the lid is placed in the position shown in FIG. 18.

Although specific dimensions are provided, it is to be understood that these dimensions may be varied as appropriate, without departing from the scope of the invention.

Figure 19:
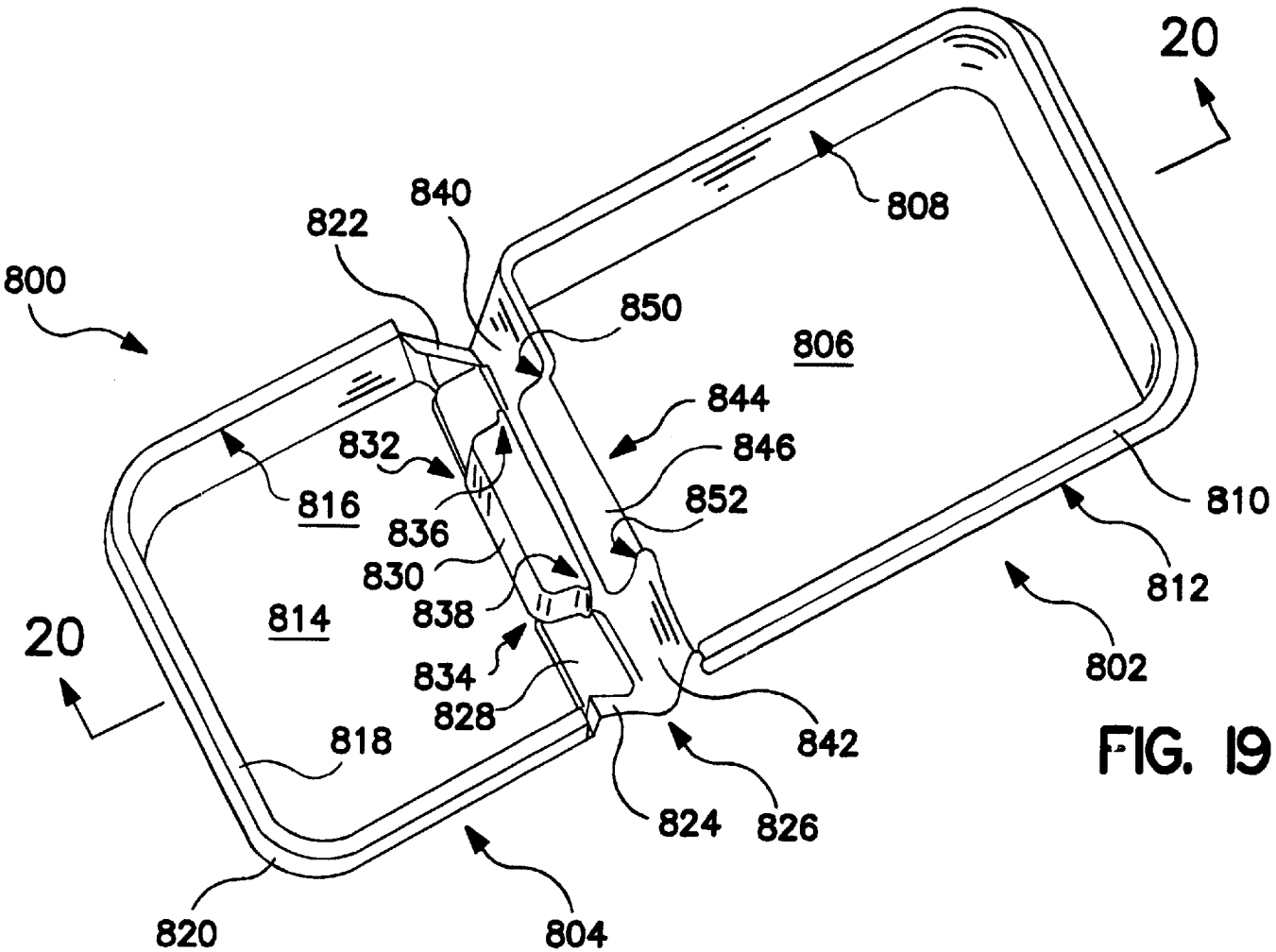
FIG. 19 is a perspective view of another alternative lid construction, preferably formed from a plastic material.
Figure 20:
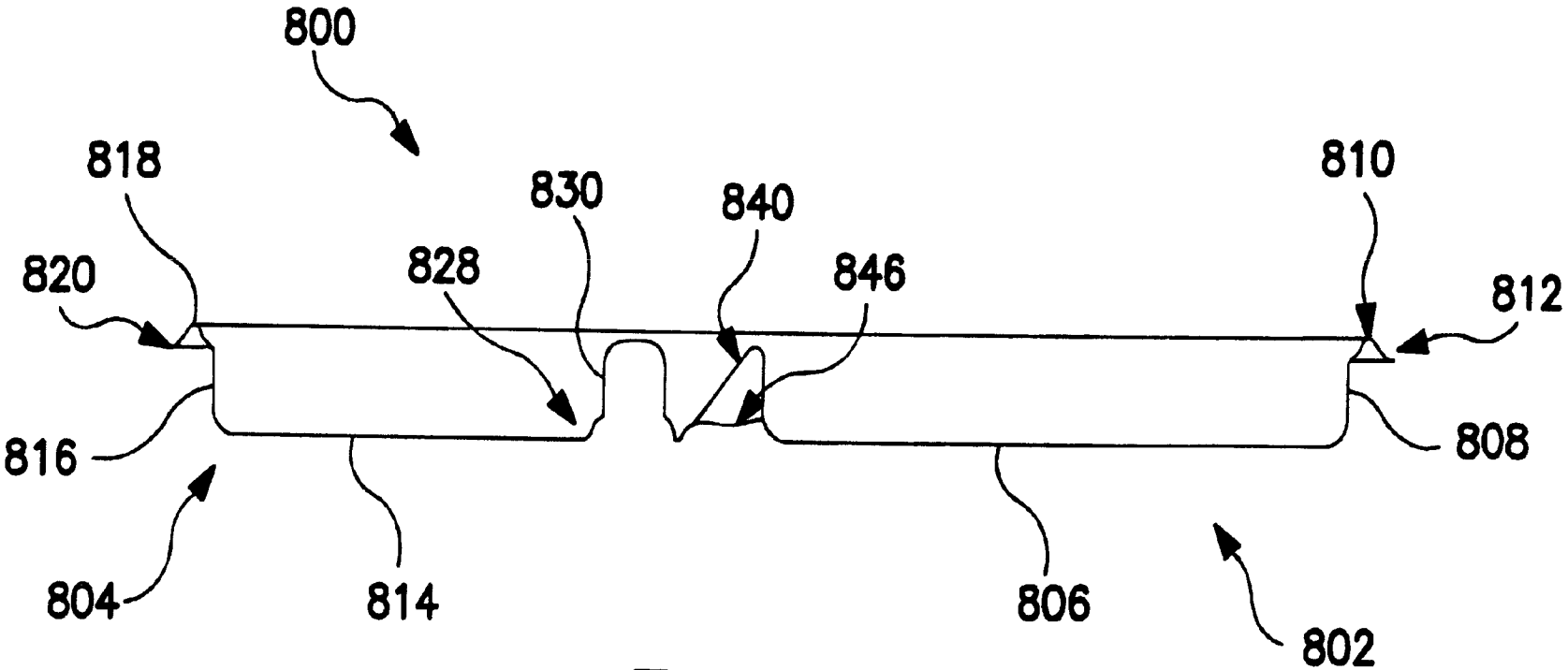
FIG. 20 is a side elevation, in section, of the lid construction of FIG. 19, taken along lines 20—20, of FIG. 19.

Another alternative lid construction is shown in FIGS. 19 and 20. Lid 800 is, like lid 704, a plug-like lid that is inserted down into the open top of a tubular body. Lid 800 is preferably formed as a single, monolithic piece, such as by injection molding. Lid 800 is preferably formed from a plastic material such as, such as polystyrene, polypropylene, LDPE, HDPE or other polymers. Lid 800 has a fixed back portion 802 and a movable front portion 804.

Back portion 802 has a panel portion 806, with an encircling upright portion (or band) 808, that ends in a turned-over top edge portion 810, and an outwardly extending lip 812. Similarly, front portion 804 has a panel portion 814, with an encircling upright portion (or band) 816, that ends in a turned-over top edge portion 818, and an outwardly extending lip 820.

Lid 800 is provided with a stay-open feature. At the rear end of front portion 804, band 816, edge portion 818 and lip 820 terminate in downwardly sloping surfaces 822 and 824, which slope toward hinge region 826. Between sloping surfaces 822 and 824, step 828 is provided which is elevated slightly above lid panel portion 814. Block 830 emanates upwardly from step 828. Block 830 preferably has slightly sloping sides, to facilitate formation through injection molding. The forward corners 832 and 834 are preferably substantially rounded. The rearward corners project outward slightly to form ribs 836 and 838.

At the front end of rear portion 802, band 808, edge portion 810 and lip 812 terminate in downwardly sloping wedge shaped regions 840 and 842, between which wedge-shaped gap 844 is formed, with step 846 defining the bottom of the gap 844. On wedge shaped regions 840 and 842, bumps 850 and 852 are formed which extend into gap 844. The spacing between bumps 850 and 852 is intended to be less that the outside distance between the outside surfaces of ribs 836 and 838.

Inasmuch as lid 800 is preferably formed from injection molding, all of the raised features, such as step 828, block 830, wedge shaped portions 840 and 842, and step 846 are all hollow underneath, as reflected in FIG. 20, a sectional side elevation of lid 800.

In operation, when front portion 804 is tipped upward to an orientation perpendicular to rear portion 802, block 830 moves between regions 840 and 842, to enter gap 844. Ribs 836 and 838 engage and "snap" past bumps 850 and 852, to releasably hold front portion 804 in the raised position, until forcibly pushed back down into a closed position.

Lid 800 may be affixed to a tubular container body, in substantially the same manner as the embodiment of FIGS. 16–18, and likewise may be employed with a separately-inserted membrane, in a similar manner. Lid 800 may also include circumferentially running ribs on the outside surfaces of bands 808 and 816 (not shown) to facilitate frictional forces for holding the lid closed. Hinge region 826 may include a crease or score extending from one side to the other, between steps 828 and 846, and/or may include intermittent perforations through the plastic to enhance bending capacity.

The foregoing description and drawings merely explain and illustrate the invention, and the invention is not limited thereto except insofar as the pending claims are so limited as those skilled in the art who have the disclosure before them will be able to make modifications and variations therein without departing from the scope of the invention.

What is claimed is:

1. A container for releasably dispensing contents contained therein, the container being convertible from a substantially sealed orientation to a substantially open, dispensing orientation and back to the substantially sealed orientation, the container comprising:

a paperboard tubular body having an upper edge defining an upper opening;

a lid, including a substantially planar lid panel member having a peripheral edge region, the lid panel member being operably configured to extend across at least a portion of the upper opening;

the lid further including a band operably connected to the lid panel member along the peripheral edge region thereof, the band extending generally at right angles to the lid panel;

at least portions of the band being juxtaposed and affixed to the tubular body along at least a portion of the tubular body proximate the upper edge thereof;

the lid having a fixed back portion for maintenance in a position juxtaposing the band to the interior of the tubular body at its upper edge, a hinge portion extending completely across the lid, and a movable front portion, pivotable at said hinge portion, between a closed position adjacent the upper edge of said tubular body and an open position enabling access to an interior region of the tubular body;

a container bottom opposite said lid, the lid being fabricated primarily from a plastic material; and wherein the lid comprises means for enabling the lid to be fixedly yet releasably positioned in a stable, open, raised position, subsequent to opening of the container and pivoting of the movable front portion of the lid up to a predetermined position, said means comprising at least a section of the fixed back portio of the lid being operably disposed to interfere with and positively engage a section of the movable front portion when the movable front portion has been moved to an upright open position, relative to the fixed back portion;

wherein the means for enabling the releasable, fixed positioning of the lid in a stable, open, raised position, subsequent to opening of the container and pivoting the movable front portion of the lid up to a predetermined position, comprise:

at least one retaining ridge, operably emanating inwardly from an inside surface of the band, disposed within the fixed back portion of the lid; and an outwardly extending lip portion, operably disposed on the movable portion of the lid at least adjacent the retaining ridge, said lip portion configured to interferingly engage with the at least one retaining ridge, when the movable portion of the lid is raised to an open position, to enable the at least one retaining ridge to hold the movable portion of the lid in said stable, releasable, raised position.

2. The container according to claim 1, wherein the lid is fabricated from at least one of the following materials: polystyrene, polypropylene, LDPE, HDPE or other polymers.

3. The container according to claim 1, further comprising at least one reinforcing rib, extending from an inside surface of the band, inwardly and downwardly to an upper surface of the lid panel, for providing structural reinforcement of the band.

4. The container according to claim 1, further comprising at least one circumferentially extending ridge, emanating from an outside surface of the band, for providing frictional engagement between the band and the inside surface of the upper end of the tubular body, upon insertion of the lid into the tubular body.

5. The container according to claim 1, further comprising a membrane extending across the upper opening of the tubular body portion, under the lid panel, and substantially independent of the lid portion.

6. The container according to claim 5, wherein the membrane is positioned on the top edge of the upper opening of the tubular body portion, below said lid.

7. The container according to claim 6, wherein the membrane is inserted into and affixed to the inside surfaces of the upper opening of the tubular body portion.

8. The container according to claim 1, wherein the lid panel is plug-shaped, so as to extend into the upper opening of the tubular body portion, when the movable front portion of the lid is in its closed position.

9. The container according to claim 1, wherein the bottom comprises a bottom panel inserted into and adhered to inside surfaces of a bottom end region of the tubular body portion.

10. The container according to claim 1, wherein the lid is monolithically formed from a single piece of plastic material.

11. The container according to claim 10, wherein the lid is formed by injecting lid material into a mold.

12. The container according to claim 1, further comprising a gripping tab emanating from a portion of the surrounding band adjacent the movable front portion, operably configured for the facilitated manual opening of the lid.

13. The container according to claim 1 wherein the lid further includes a lip emanating outwardly from an upper edge region of the band, around the substantial entire circumference of the band.

14. The container according to claim 13 wherein said lip rests on the upper edge of the tubular body of the container upon insertion of the lid into the tubular body, to assist in maintaining the lid in a secured position inside the tubular body.

15. The container according to claim 1 wherein the band of the lid includes a beveled portion at its lower edge, to facilitate insertion of the lid into the tubular body of the container.

16. A container for releasably dispensing contents contained therein, the container being convertible from a substantially sealed orientation to a substantially open, dispensing orientation and back to the substantially sealed orientation, the container comprising:

a paperboard tubular body having an upper edge defining an upper opening;

a lid, including a substantially planar lid panel member having a peripheral edge region, the lid panel member being operably configured to extend across at least a portion of the upper opening;

the lid further including a band operably connected to the lid panel member along the peripheral edge region thereof, the band extending generally at right angles to the lid panel;

at least portions of the band being juxtaposed and affixed to the tubular body along at least a portion of the tubular body proximate the upper edge thereof;

the lid having a fixed back portion for maintaining the lid in a position juxtaposing the band to the interior of the tubular body at its upper edge, a hinge portion extending completely across the lid, and a movable front portion, pivotable at said hinge portion, between a dosed position adjacent the upper edge of said tubular body and an open position enabling access to an interior region of the tubular body;

a container bottom opposite said lid, the lid being fabricated primarily from a plastic material; and wherein the lid comprises means for enabling the lid to be fixedly yet releasably positioned in a stable, open, raised position, subsequent to opening of the container and pivoting of the movable front portion of the lid up to a predetermined position, said means comprising at least a section of the fixed back portion of the lid being operably disposed to interfere with and positively engage a section of the movable front portion when the movable front portion has been moved to an upright open position, relative to the fixed back portion; and at least one reinforcing rib, extending from an inside surface of the band, inwardly and downwardly to an upper surface of the lid panel, for providing structural reinforcement of the band.

* * * * *